US007044137B2

(12) United States Patent
Glucksman et al.

(10) Patent No.: US 7,044,137 B2
(45) Date of Patent: May 16, 2006

(54) HAIR TREATING DEVICE

(75) Inventors: Dov Z. Glucksman, Wenham, MA (US); Gary P. McGonagle, Lynn, MA (US); Laura J. Nickerson, Andover, MA (US)

(73) Assignee: Appliances Development Corporation, Danvers, MA (US)

( * ) Notice: Subject to any disclaimer, the term of this patent is extended or adjusted under 35 U.S.C. 154(b) by 523 days.

(21) Appl. No.: 10/227,145

(22) Filed: Aug. 23, 2002

(65) Prior Publication Data

US 2004/0035435 A1 Feb. 26, 2004

(51) Int. Cl.
*A45D 24/22* (2006.01)

(52) U.S. Cl. ..... 132/114; 132/112

(58) Field of Classification Search ..... 132/112–116; 222/191, 209, 386.5, 214, 401; 401/6, 28, 401/201

See application file for complete search history.

(56) References Cited

U.S. PATENT DOCUMENTS

| | | | | |
|---|---|---|---|---|
| 3,861,407 | A | 1/1975 | Gabriele | 132/108 |
| 3,960,160 | A | 6/1976 | Hogan | 132/112 |
| 3,961,635 | A | 6/1976 | Miya | 132/11 |
| 3,964,501 | A | 6/1976 | Matchett | 132/11 |
| 4,143,667 | A | 3/1979 | Peilet | 401/28 |
| 4,211,247 | A | 7/1980 | Morganroth | 132/88.7 |
| 4,224,954 | A | 9/1980 | Stahl | 132/7 |
| 4,294,270 | A | 10/1981 | Cochran | 132/112 |
| 4,319,852 | A | 3/1982 | Bell et al. | 401/185 |
| 4,364,515 | A | 12/1982 | Prussin | 239/8 |
| 4,385,638 | A | 5/1983 | Hasegawa | 132/88.5 |
| 4,592,376 | A | 6/1986 | Sigmund et al. | 132/112 |
| 4,597,683 | A | 7/1986 | Wittersheim et al. | 401/4 |
| 4,658,840 | A | 4/1987 | McCosker | 132/7 |
| 4,665,933 | A | 5/1987 | Zinger et al. | 132/9 |
| 4,687,663 | A | 8/1987 | Schaeffer | 424/52 |
| 4,747,420 | A | 5/1988 | Alaimo | 132/112 |
| 4,881,558 | A | 11/1989 | Hollenberg et al. | 132/112 |
| 4,902,154 | A | 2/1990 | Valenza | 401/132 |
| 4,922,859 | A | 5/1990 | Durell et al. | 119/83 |
| 4,942,893 | A | 7/1990 | Trottier | 132/270 |
| 4,958,647 | A | 9/1990 | Busch et al. | 132/119.1 |
| 4,961,439 | A | 10/1990 | Hartmann | 132/212 |
| 4,964,539 | A | 10/1990 | Mueller | 222/94 |
| 5,000,199 | A | 3/1991 | Kuranski et al. | 132/112 |
| 5,002,075 | A | 3/1991 | Kellett et al. | 132/108 |
| 5,006,004 | A | 4/1991 | Dirksing et al. | 401/261 |
| 5,020,694 | A | 6/1991 | Pettengill | 222/137 |
| 5,024,243 | A | 6/1991 | Snyder | 132/116 |
| 5,053,218 | A | 10/1991 | Shernov | 424/47 |
| 5,054,504 | A | 10/1991 | Winrow | 132/114 |
| 5,056,480 | A | 10/1991 | Murray, Sr. | 132/114 |
| 5,056,538 | A | 10/1991 | Matula | 132/208 |

(Continued)

FOREIGN PATENT DOCUMENTS

| | | |
|---|---|---|
| DE | 3048827 | 7/1982 |
| EP | 0043519 | 1/1982 |
| EP | 0038024 | 3/1986 |
| JP | 9023922 | 1/1997 |
| WO | 9846202 | 10/1998 |

*Primary Examiner*—John J. Wilson
*Assistant Examiner*—Robyn Doan
(74) *Attorney, Agent, or Firm*—George A. Herbster

(57) ABSTRACT

A hair treating device for applying solution to hair includes a hollow member with dispensing ports, an inflatable bladder and a handle. The inflatable bladder is positioned in a manifold with the solution to be dispensed. The handle is sealed from the solution and has a pump. Operating the pump expands the bladder and ejects the solution through the dispensing ports.

18 Claims, 10 Drawing Sheets

U.S. PATENT DOCUMENTS 5,059,050 A 10/1991 Guglielmo ..... 401/171
5,067,444 A * 11/1991 Parker ..... 119/606
5,119,838 A 6/1992 Nakazima ..... 132/108
5,146,936 A 9/1992 Ng ..... 132/208
5,146,937 A 9/1992 Lefebvre ..... 132/208
5,152,305 A 10/1992 Niv ..... 132/112
5,188,132 A 2/1993 Barkus ..... 132/219
5,215,106 A 6/1993 Choi ..... 132/109
5,289,833 A 3/1994 McDonald ..... 132/112
5,289,835 A 3/1994 Harlan et al. ..... 132/313
5,291,905 A 3/1994 Busch et al. ..... 132/116
5,301,695 A 4/1994 Wong ..... 132/108
5,335,679 A 8/1994 Baxter ..... 132/270
5,339,839 A 8/1994 Forcelledo et al. ..... 132/114
5,343,880 A 9/1994 McKay ..... 132/116
5,433,225 A 7/1995 Liggett et al. ..... 132/208
5,469,873 A 11/1995 Guth ..... 132/270
5,472,456 A 12/1995 Larsky et al. ..... 8/405
5,483,979 A 1/1996 Bertieri ..... 132/114
5,499,637 A 3/1996 Foti ..... 132/200
5,533,537 A 7/1996 Mourad ..... 132/148
5,551,454 A 9/1996 Goncalves ..... 132/208
5,555,899 A 9/1996 Foreman ..... 132/114
5,558,453 A 9/1996 Bell et al. ..... 401/137
5,562,111 A 10/1996 Torres ..... 132/270
5,584,309 A 12/1996 De Beneditis et al. ..... 132/208
5,588,449 A 12/1996 Falcon ..... 132/208
5,655,551 A 8/1997 Knight ..... 132/200
5,660,191 A 8/1997 Bontoux et al. ..... 132/211
5,664,590 A 9/1997 Plateroti et al. ..... 132/270
5,676,480 A 10/1997 Tosto ..... 401/10
5,709,910 A 1/1998 Argyle et al. ..... 427/434.2
5,725,130 A 3/1998 Kluge et al. ..... 222/192
5,778,902 A 7/1998 Nagy ..... 132/200
5,845,653 A 12/1998 Abercrombie ..... 132/208
5,848,598 A 12/1998 Walz et al. ..... 132/112
5,913,314 A 6/1999 Garrett ..... 132/112
5,927,290 A 7/1999 Thiruppathi ..... 132/116
5,937,864 A 8/1999 Diaz ..... 132/112
5,937,865 A 8/1999 Dhaliwal ..... 132/114
5,937,866 A 8/1999 Magharehi ..... 132/116
5,975,089 A 11/1999 Simon ..... 132/113
6,000,405 A 12/1999 De Laforcade ..... 132/116
6,022,163 A 2/2000 Asfur ..... 401/175
6,047,703 A 4/2000 Paglericcio et al. ..... 132/113
6,065,891 A 5/2000 Rehman et al. ..... 401/183
6,145,513 A 11/2000 Chu et al. ..... 132/112
D442,331 S 5/2001 Pannozzo et al. ..... D28/7
6,334,449 B1 1/2002 Burrows et al. ..... 132/114
6,367,483 B1 4/2002 Chen et al. ..... 132/112

* cited by examiner

HAIR TREATING DEVICE

BACKGROUND OF THE INVENTION

1. Field of the Invention

This invention generally relates to devices for treating hair and more specifically to a device for delivering solutions, such as hair coloring, to selected portions of the scalp and hair.

2. Description of Related Art

There have been many efforts to develop hair treating devices. These efforts include developing devices for supplying hair coloring and other solutions to the scalp and hair, particularly devices readily adapted for home use. For example, U.S. Pat. No. 3,961,635 (1976) to Miya discloses an applicator and device that has a flexible supply reservoir, a cap portion attached to the reservoir and a comb tooth support member attached to the cap portion. Several comb teeth extend from the support member. An individual manually squeezes the flexible supply reservoir to force a solution through passageways in the cap portion, the comb teeth support member and each of the comb teeth.

U.S. Pat. No. 5,024,243 (1991) to Snyder discloses a comb for selective hair coloring with a similar structure. In this patent the coloring comb includes a reservoir with a squeeze bottle and a tube that transfers the material to selected dispensing ports.

In each device, squeezing the bottle forces solution in the bottle through a distribution channel and out dispensing ports formed in the comb teeth. However, in each an inlet to the distribution channel generally is spaced from one end of the bottle. As a result, it is difficult to completely dispense all the solution. Specifically, if the device is oriented such that its inlet is above the level of solution in the reservoir, no transfer of solution from the reservoir can occur unless the bottle is squeeze sufficiently to force all the solution above the inlet.

U.S. Pat. No. 4,294,270 (1981) to Cochran discloses a hair treating fluid applicator with a manifold backbone that communicates with the reservoir. A plurality of teeth extend from the backbone at right angles thereto and axial passages communicate with the manifold to supply solution to the tips of the teeth. A sponge material in the backbone transfers solution to the passages by capillary action from the reservoir.

German Patent No. DE 3048827 (1982) to Konrad et al., U.S. Pat. No. 5,339,839 (1994) to Forcelledo et al. and U.S. Pat. No. 5,927,290 (1999) to Thiruppathi disclose dispensers with various pumps for applying solutions to the hair. Generally speaking in each a preloaded capsule with a solution is inserted into a container. The pump acts on the capsule to displace the solution through comb teeth for application to the hair.

In accordance with U.S. Pat. No. 5,975,089 (199) to Simon a hair brush applicator has a handle portion and a head portion. The head portion has various bristles and a plurality of dispensing ports in the form of lateral apertures. A handle portion has an end cap that can be removed to fill a chamber in the handle with a solution. After the cap is replaced, a flexible portion of the container extends through a handle housing to allow the container to be compressed forcing solution through the teeth.

U.S. Pat. No. 6,145,513 (2000) to Chu et al. discloses a similar dispensing device in which a conduit and a manifold communicates with the inside surface of a dispensing device. A handle includes a pump structure to increase air pressure around a solution container to force that solution into the manifold formed by spaced lips that permit the distribution of solution through dispensing ports in intermediate comb teeth in a comb head.

U.S. Pat. No. 6,334,449 (2002) to Burrowes et al. discloses another delivery system in which a flexible container stores a solution. The container is placed in a handle. A conduit is located inside the flexible container. Squeezing the handle increases the air pressure on the exterior of the container and forces solution through the conduit into a dispensing head including a comb structure with passageways through the individual teeth.

Each of these devices has certain disadvantages with respect to the manufacture of an inexpensive and effective hair coloring device. For example, the devices of U.S. Pat. Nos. 3,961,635 and 5,024,243 rely on a squeeze bottle with a dispensing tube that, with appropriate orientations as normally encountered can result in forcing air through the dispensing tube even though additional solution remains in the container.

Devices such as those shown in U.S. Pat. No. 4,294,270, German Patent No. DE 3,048,827 and U.S. Pat. Nos. 5,339,830 and 5,927,290 disclose systems that incorporate pumps and related devices that could overcome the problem of complete dispensing of a solution. However, these devices contain complex structures that increase the overall cost of such a device.

It would be preferable if such a device eliminated any cleaning requirement. One approach is to provide all components that contact solutions as disposable components. To be disposable, a component must have very low manufacturing costs. However, devices such as shown in U.S. Pat. Nos. 5,975,089, 6,145,153 and 6,334,449 disclose pump and valve structures for controlling the flow of solution control that contact the solution flow itself and therefore require cleaning. Normally pumps and valves are reusable because inexpensive disposable pumps and valves are not available. As a result, any component that contains a pump or valve becomes too expensive to provide as a disposable component. Consequently existing devices continue to use non-disposable components that must be cleaned after each use.

SUMMARY

Therefore it is an object of this invention to provide a device for applying a solution to the hair which is easy to use and which dispenses solutions reliably in all orientations of the device.

Another object of this invention is to provide a device for applying a solution to the hair that facilitates that application and eliminates the need for cleaning of any components that the solution contacts.

Still another object of this invention is to provide a device for applying a solution to the hair that is reliable to use and that can be manufactured with disposable components to eliminate any cleaning requirements.

In accordance with one aspect of this invention, an applicator for applying a solution to hair includes a hollow member, an inflatable bladder and a handle. The hollow member forms a manifold with a plurality of dispensing ports for dispensing the solution and a fill port for receiving the solution. The inflatable bladder positioned in the manifold seals the fill port. The handle connects to the bladder and hollow member proximate the fill port and includes a pump for expanding the bladder thereby to dispense solution from the manifold through the dispensing ports.

In accordance with another aspect of this invention, an applicator for applying hair dye to selected portions of a person's hair includes a comb member, an inflatable member and a handle. The comb member has a housing with open and closed ends defining a cavity therebetween and includes a plurality of comb teeth extending from the housing. Each comb tooth has a passage for dispensing hair dye from the cavity through the comb tooth whereby the cavity and tooth passages define a manifold. The inflatable member resides in the cavity and extends through the open end of the housing. The inflatable member includes a support body for sealing against the comb member housing. A conduit extends through the support body to define an air passage and a balloon overlies the conduit on one side of the support body whereby the balloon is immersed in the hair dye in the housing cavity. The handle contains an air pump with an outlet port that can be sealed to the conduit on the other side of the support body. Operation of the air pump expands the balloon and displaces hair dye from the cavity through each passage in the comb teeth.

In accordance with still another object of this invention a hair dye applicator includes a dispenser with a fill port from which hair dye in a cavity is dispensed through passages in a plurality of comb teeth. An inflatable structure extends through the fill port into the cavity to be expanded thereby to dispense the hair dye. A seal between the dispenser and the inflatable structure prevents hair dye from escaping through the fill port. A handle attaches to the dispenser and the inflatable structure for enabling an individual to grasp the hair dye applicator and operate a pump for directing air into the inflatable structure. This action expands the inflatable structure and displaces hair dye from the cavity. Another seal between the handle and the dispenser prevents hair dye from entering the handle.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
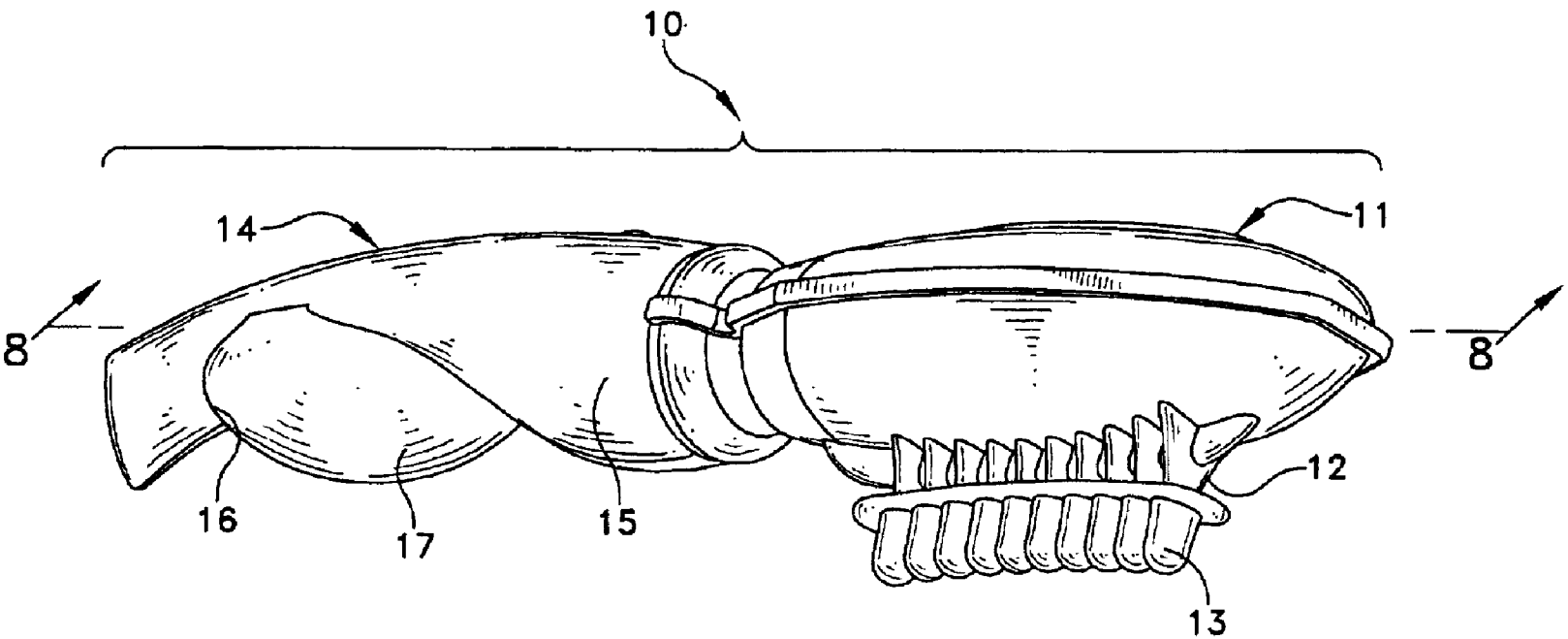
FIG. 1 is a perspective view of a hair dye applicator constructed in accordance with this invention.
Figure 2:
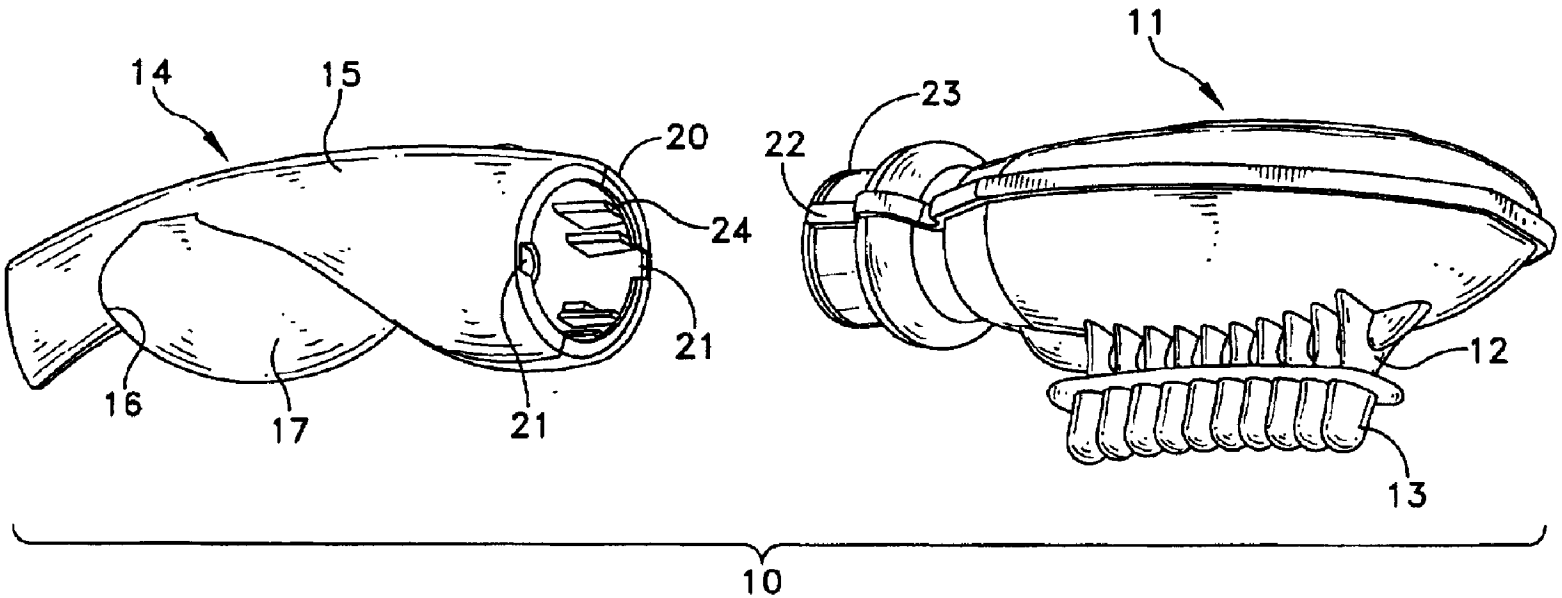
FIG. 2 is a partially exploded view of the hair dye applicator show in FIG. 1.

In FIGS. 1 and 2 an applicator for applying a solution to hair appears in the form of a hair dye applicator 10. The hair dye applicator 10 includes, as a first of three major components, a hollow or comb member 11. Comb teeth 12 dispense the solution and constitute a plurality of dispensing ports. An optional cover 13 can be placed over the comb teeth 12 to close the dispensing ports and block any dispensing action.

The second major component is a handle member 14 that has a body portion 15 with an access window 16 that makes a portion of a squeeze bulb 17 accessible to a user. When the hollow member 11 contains a solution and the cover 13 is removed, compressing the squeeze bulb 17 causes the solution to dispense through the comb teeth 12.

Figure 3:
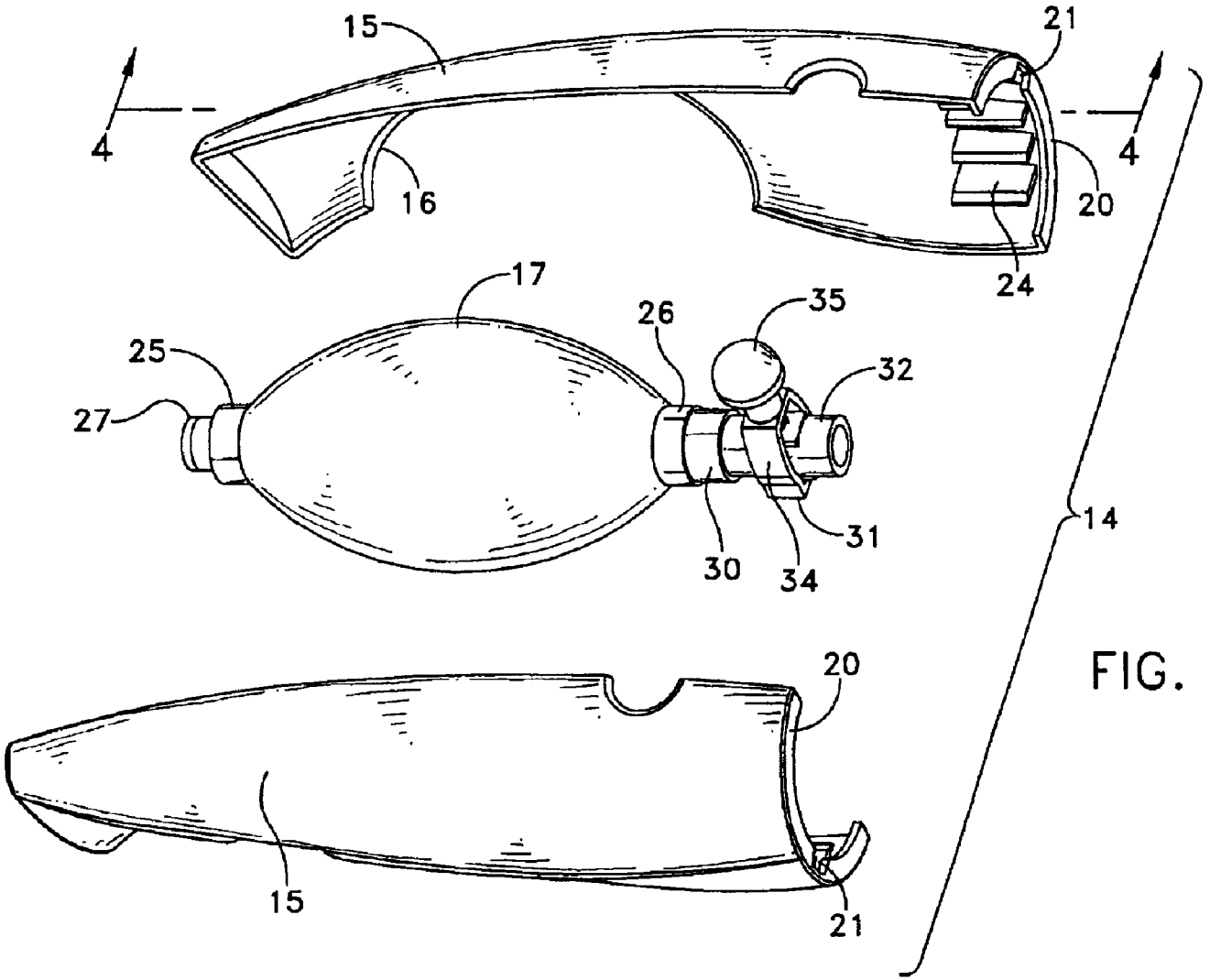
FIG. 3 is a an exploded view of a handle shown in FIGS. 1 and 2.

Referring to FIGS. 2 and 3, the handle member 14 has a first end formed by a radial shoulder 20 and keyways 21 that interengage longitudinal keys 22 integrally formed on an exterior of the hollow member 11 at an open end 23. The handle member 14 additionally includes a plurality of radial arms or projections 24 adjacent the shoulder 20 that provide a centering function. In addition the radial arms 24 adjacent the keyways 21 form radial stops for the keys 22. Thus separating the handle member 14 from the hollow member 11 is a simple task merely requiring an individual to twist the hollow member 11 and handle 14 relative to each other until the keyways 21 and keys 22 align whereupon the two units can be separated. That is, the keys, keyways and stops form complementary releasable locking elements. More specifically, the shoulder 20, keyways 21 and keys 22 are one example of a quick-release twist-lock mechanism for affixing the handle member 14 to be attached to and detached from the hollow member 11.

Figure 4:
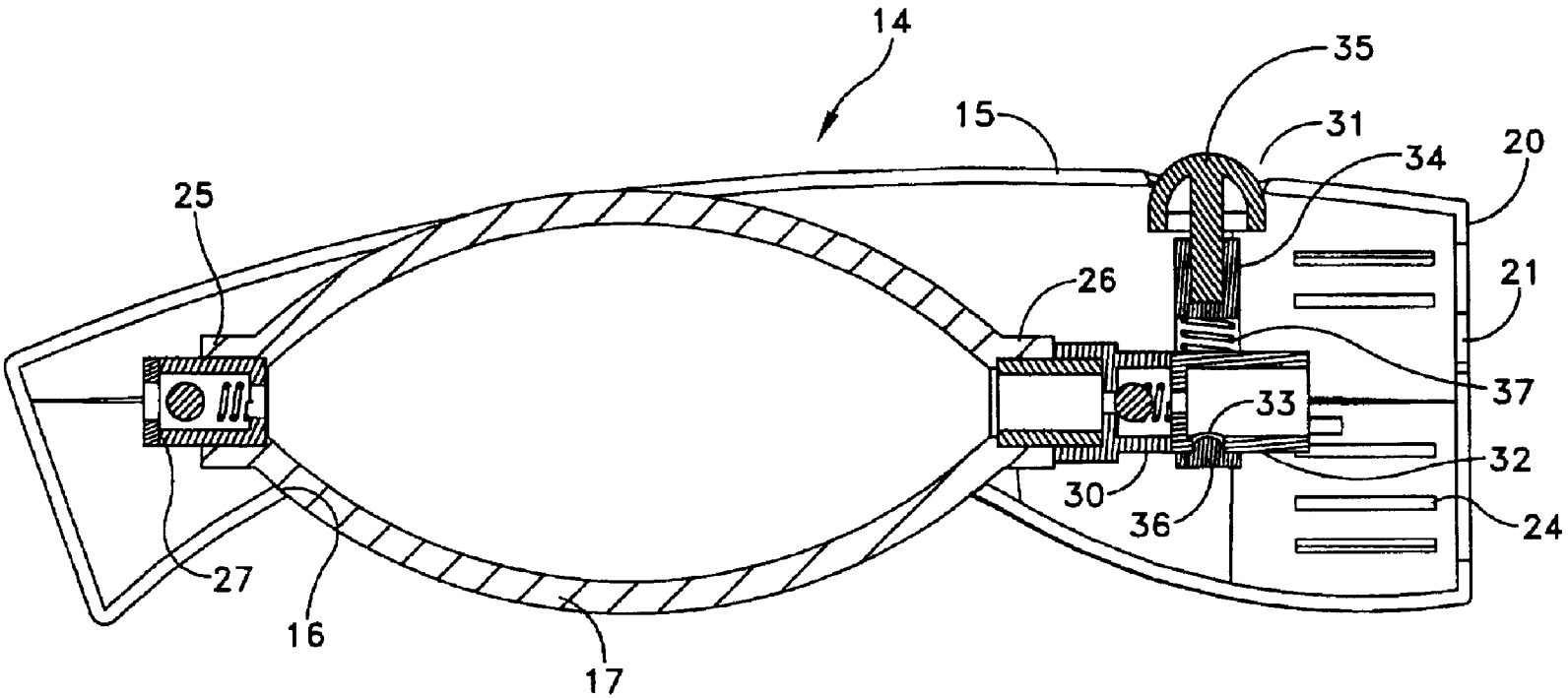
FIG. 4 is a sectional view of an assembled handle taken along lines 4—4 in FIG. 3.

FIGS. 3 and 4 depict details of the handle member 14. More specifically the squeeze bulb 17, that resides inside the body portion 15, has two axially aligned and spaced ports or couplings 25 and 26. The coupling 25 acts as an input port and carries a one-way inlet valve 27; the coupling 26 acts as an output port and carries a one-way outlet valve 30. In this specific embodiment each one-way valve comprises a spring-biased ball valve as well known in the art. When the bulb 17 is fully relaxed, both the valves 27 and 30 are closed. When an individual squeezes the bulb 17, the pressure inside the squeeze bulb 17 increases and moves the one-way valve 30 to an open position while the one way valve 27 remains closed. Conversely, when an individual releases the squeeze bulb 17, the one-way valve 30 closes, but the one-way valve 27 opens until the interior pressure within the bulb 17 reaches atmospheric pressure.

The handle member 14 also includes a manually-operated pressure relief valve 31 that mounts on an extension 32 from the valve 30 and that has a pressure relief port 33. This valve 31 includes a body 34 that extends radially with respect to the extension 32 and a valve actuator 34 with a thumb pad 35. Depressing the thumb pad 35 moves a sealing seat 36 away from the port 33 against the bias of a spring 37. If the pressure in the bulb 17 or within the extension 32 is greater than atmospheric pressure, pressing the thumb tab 35 releases that pressure and terminates any dispensing action at the comb teeth 12 shown in FIGS. 1 and 2.

Figure 5:
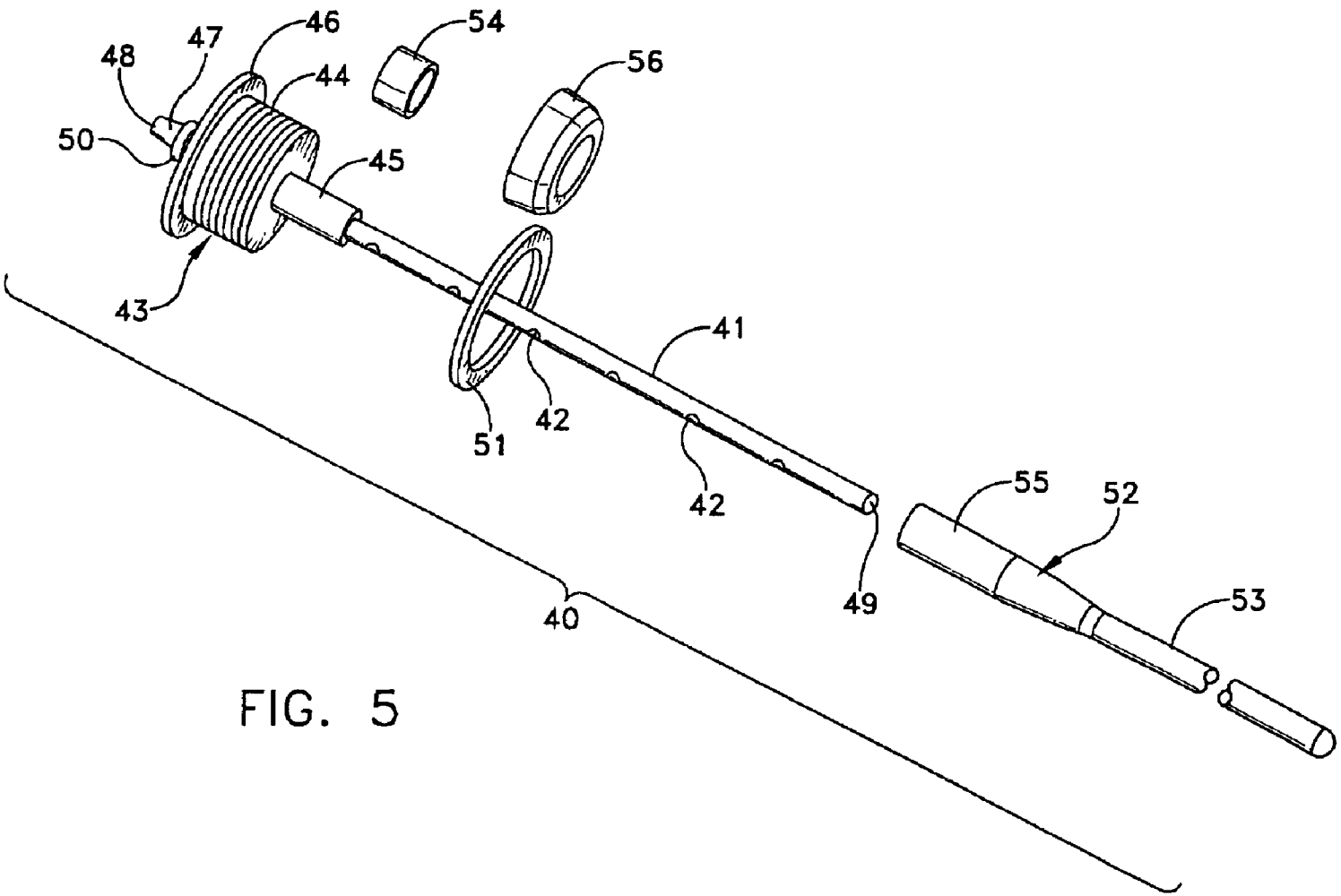
FIG. 5 is an exploded view of an inflatable bladder assembly utilized in the applicator of FIG. 1.
Figure 6:
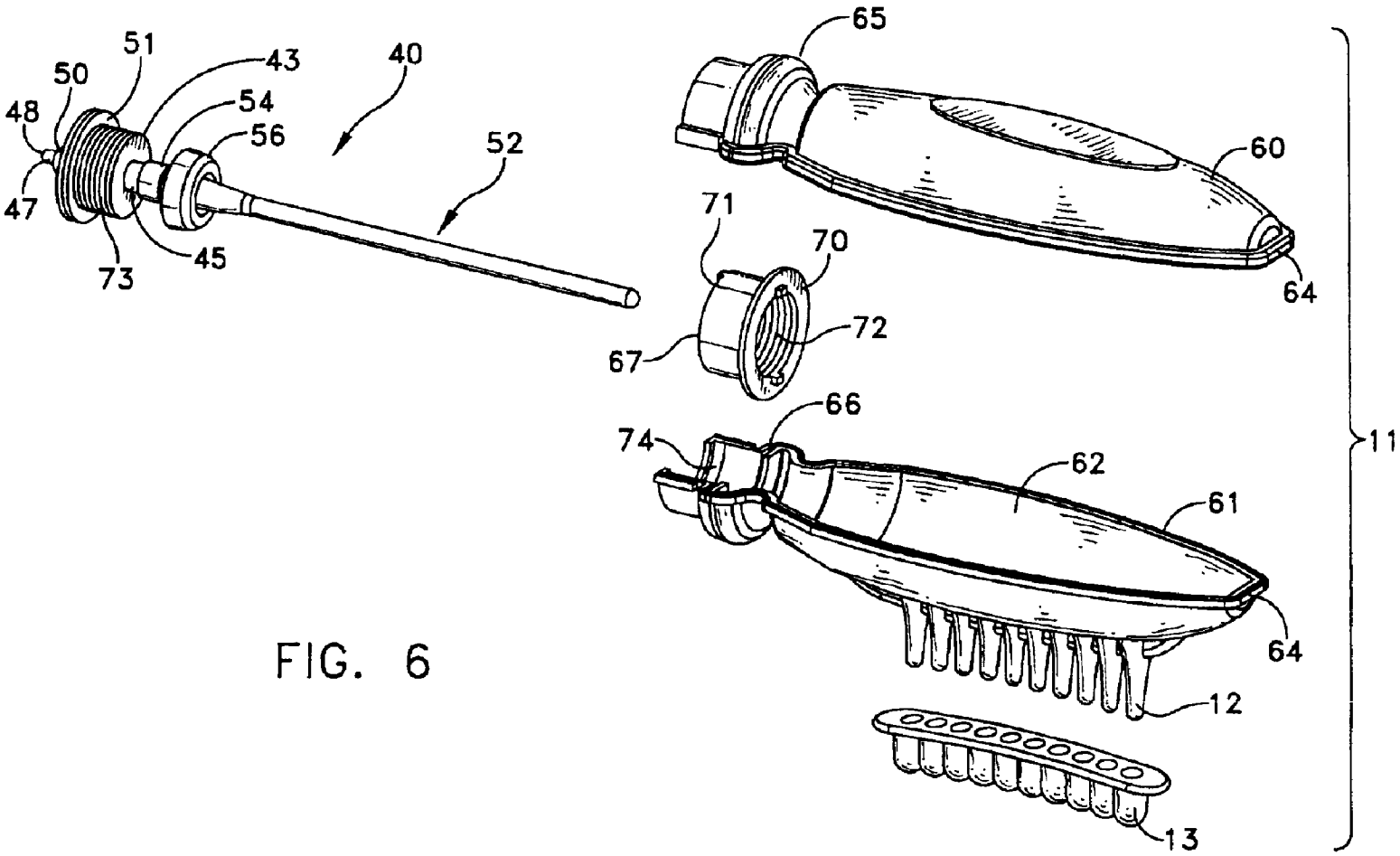
FIG. 6 depicts an assembled inflatable bladder assembly and a hollow member constructed in accordance with this invention.

Squeezing the bulb 17 forces air through the one-way valve 30 and extension 32 into the third major component that is an inflatable bladder member 40 shown in FIGS. 5 and 6. The inflatable bladder member 40 includes a straw or conduit 41 with axially spaced apertures 42 that direct and distribute air from the interior of the conduit or straw 41. A sealing cap 43 has a main body portion 44, an axially extending coupling 45 and a radial shoulder 46 on opposite sides of the body portion 44. A central passage extends through the cap 43 and receives an end portion of the conduit or straw 41 so that a tapered portion 47 extends beyond the shoulder 46 to a first end 48 that is spaced from a second end 49. The first end 48, as an inlet end, seats an O-ring 50. An annular seal 51 overlies the body portion 44 and abuts the shoulder 46.

An inflatable bladder in the form of a balloon 52 has an overlying expansible body section 53 that extends over the conduit or straw 41 from the second end 49 to a position adjacent the support body 43. A balloon clip 54 clamps and seals a neck portion 55 to the coupling 45. The expansible section 53 thereby defines a closed expansible volume that is coextensive with the apertures 42. As a final element, a flow stop 56 overlies portions of the coupling 53 and abuts against the balloon clip 54.

Figure 7:
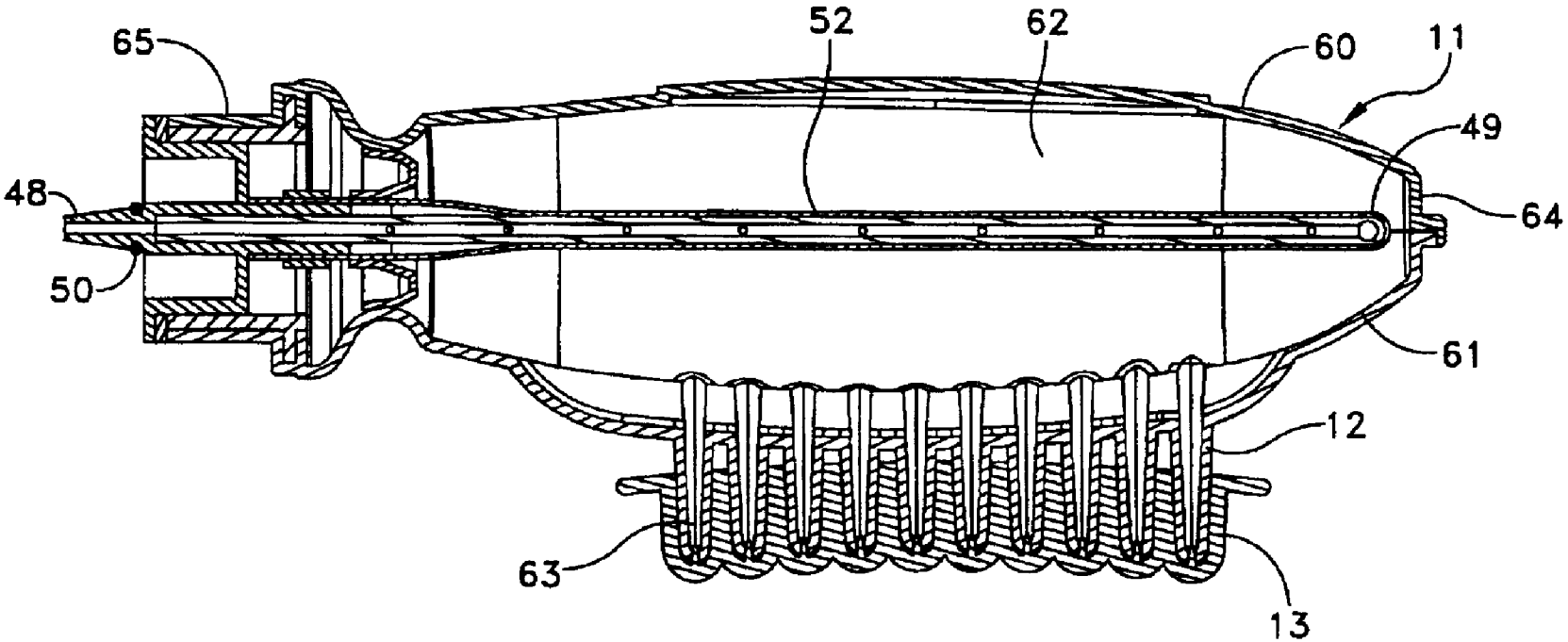
FIG. 7 is a section view taken generally along lines 7—7 in FIG. 6 of the assembled inflatable bladder assembly and hollow member.

As particularly shown in FIG. 6 the inflatable bladder member 40 is positioned in the hollow member 11 that includes top and bottom elements 60 and 61 that form a housing and a manifold comprising an internal cavity 62 and longitudinal passages 63. As specifically shown in FIG. 7 the longitudinal passages 63 provide paths for solution from the cavity 62 through the ends of the comb teeth 12 when the cover 13 is removed.

The hollow member 11 includes a closed end 64 and an open neck end 65. The open neck end 65 includes a internal circumferential channel 66 that receives a cylindrical insert 67. The insert 67 has a radial shoulder 70 and a cylindrical body portion 71 with internal threads 72. The internal threads 72 mate with external threads 73 on the cap 43.

Figure 8:
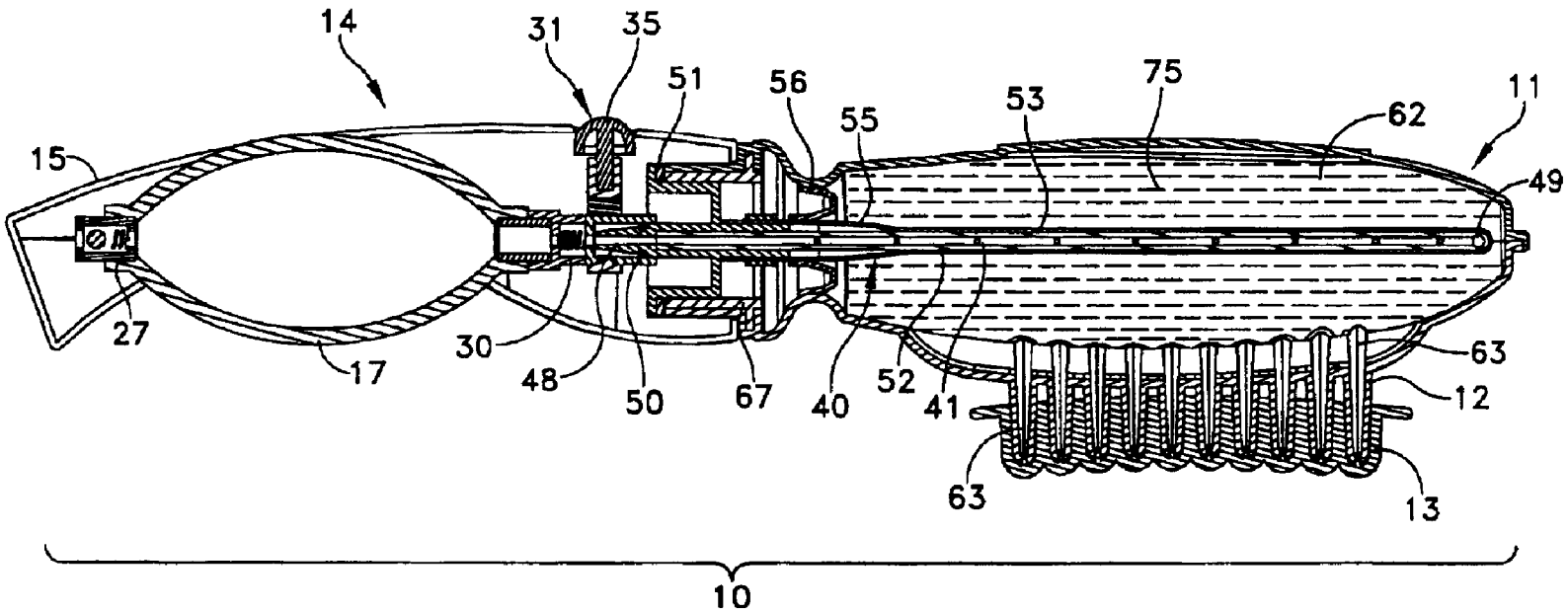
FIGS. 8 and 9 are section views taken generally along lines 8—8 in FIG. 1 of the completely assembled applicator.
Figure 9:
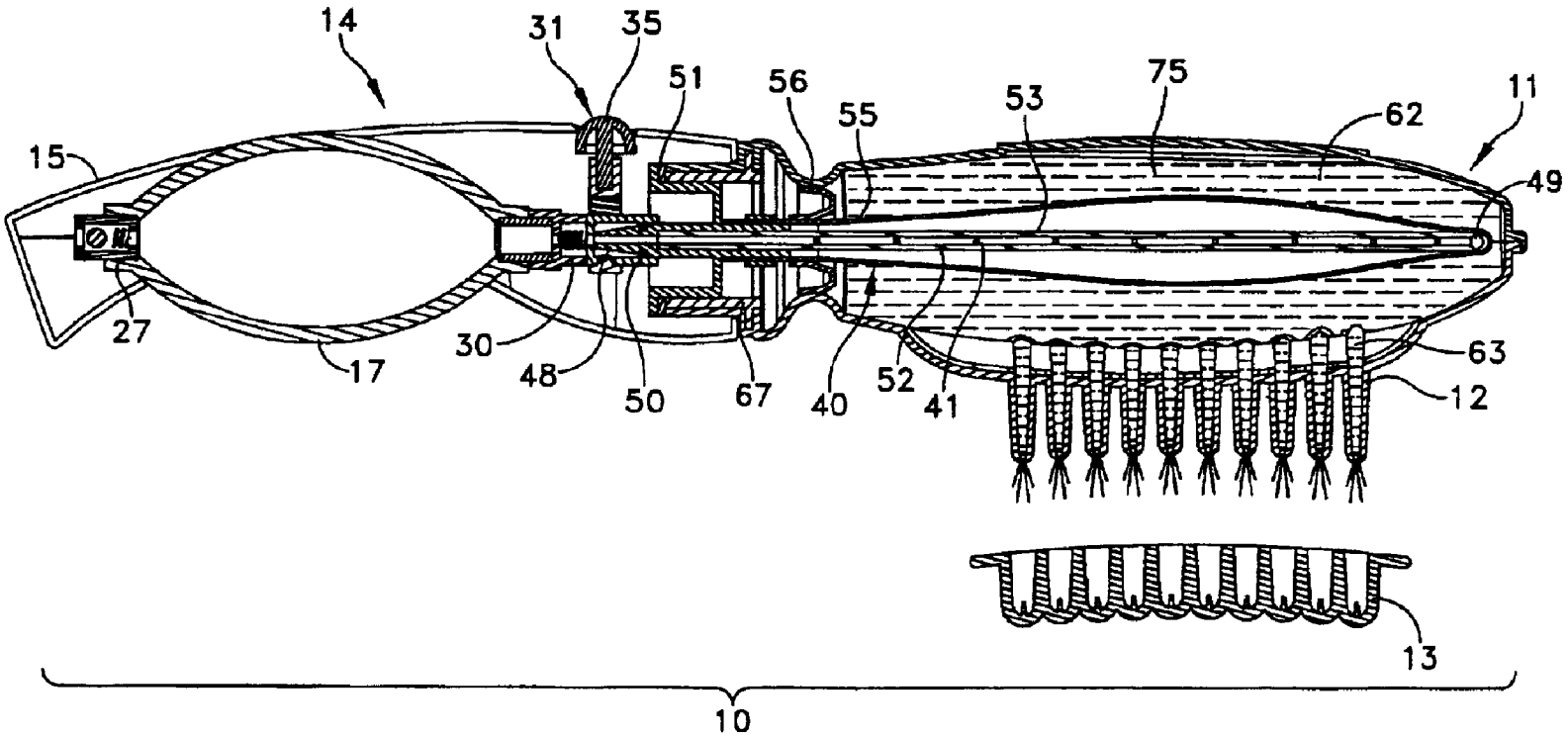

Referring to FIGS. 8 and 9, to use the applicator 10, an individual places the cover 13 over the comb teeth 12 and then orients the hollow member 11 in a vertical orientation to fill the cavity 62 with a solution through a fill port 74 at the neck 65. Next the individual inserts the inflatable bladder member 40 through the neck portion 65 and twists the assembly until the threads 73 fully seat in the threaded insert 67. Then the individual attaches the handle member 14 to form the final assembly as shown in FIGS. 8 and 9. FIG. 8 depicts the applicator 10 in a fully filled condition with the cavity 62 filled with a solution 75 and the expansible section 55 of the balloon 52 fully collapsed on the straw 41.

Figure 10:
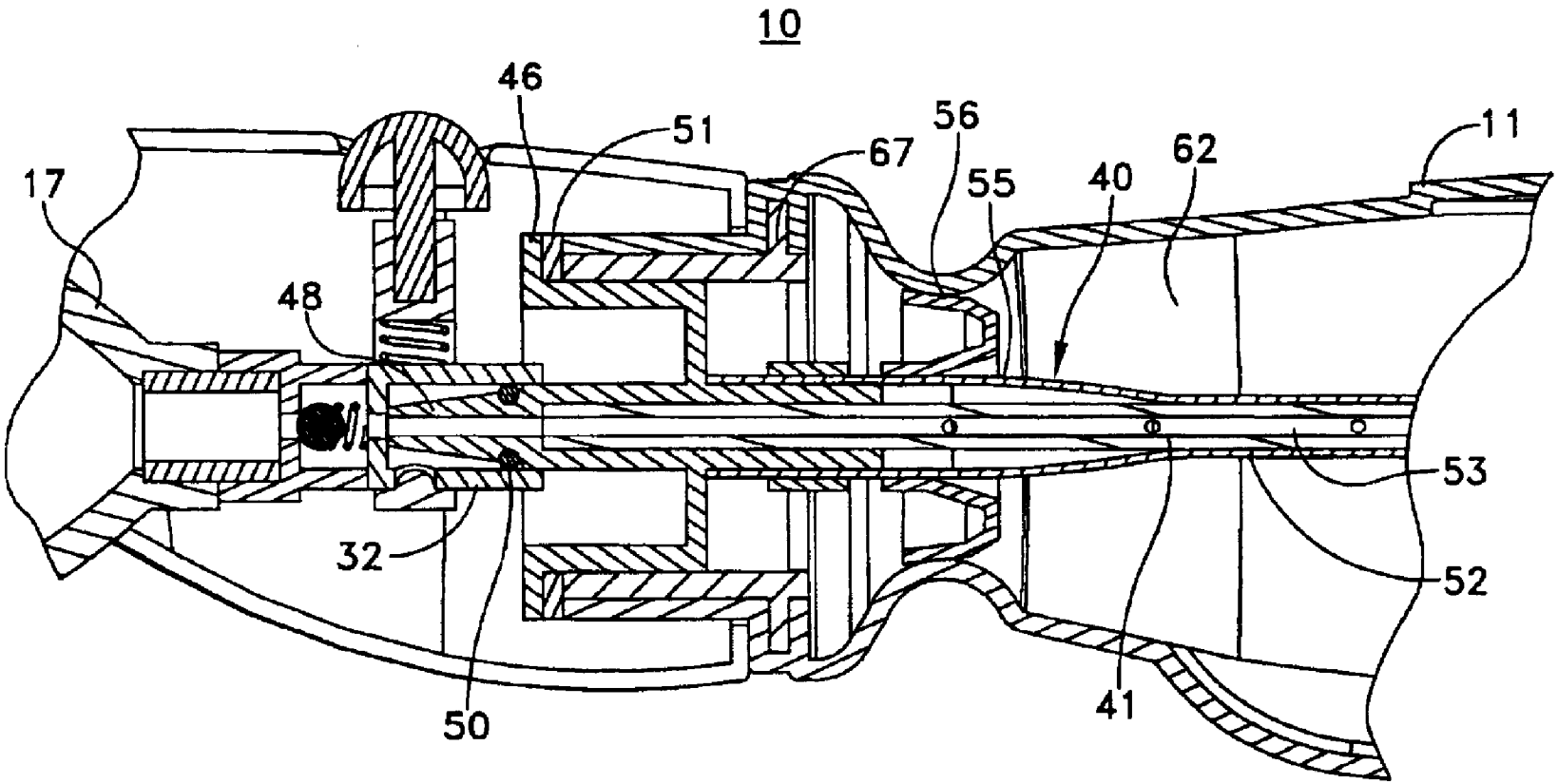
FIG. 10 is an enlarged detailed view of a portion of the assembled applicator shown in FIGS. 8 and 9.

Referring to FIGS. 8 through 10, the O-ring 50, annular seal 51 and flow stop 56 perform various sealing functions. The O-ring 50 provides a seal between the body 32 and the inlet end 48 to block any escape of air from the balloon 52. This, together with the operation of the one-way valve 30 prevents any collapse of the balloon 52 between successive squeezing of the squeeze bulb 17.

The annular seal 51 is a primary seal between the radial shoulder 46 and an end surface 76 on the insert 67. This seal prevents any solution from escaping past the combined hollow member 11 and inflatable bladder member 40.

The balloon 52, flow stop 56 and balloon clip 54 prevent any solution 75 from entering the conduit 41 through the interface between the balloon neck 55 and the conduit 41. In addition, the flow stop 56 closes the cavity 62 and essentially blocks any solution 75, particularly a solution with any viscosity, from flowing out of the cavity 62 past the flow stop 56. This confines the solution to portions of the cavity 62 that are coextensive with the expansible balloon section 53 to assure that essentially all the solution 75 can be dispensed from the cavity 62.

Now with the hollow member 11, handle member 14 and inflatable bladder 40 assembled with solution 75 in the cavity 62 as shown in FIGS. 8 and 9, the individual removes the cover 13. As will be apparent, assuming that the pressure relief valve 31 has been activated to relieve any pressure, the cover 13 can be removed without any material being dispensed. This is particularly true if the comb teeth 12 are oriented to extend above the hollow comb member 11.

As the individual moves the comb teeth 12 through the hair and squeezes the bulb 17, air in the bulb 17 passes through the one-way valve 30 and then through the central passage of straw 41 to exhaust through the apertures 42 thereby to begin to expand the expansible portion 55 of the balloon 52. This action forces the solution 75 to be dispersed through the passages 63 in the comb teeth 12. In effect, the hollow member 11 forms a manifold with a plurality of dispersing ports FIG. 9 depicts a partial expansion of the balloon. As will be apparent this expansion applies equal pressure to the solution 75 throughout the cavity 62 and continues to force the solution through the passages 63. Further, it will now be apparent that fully expanding the balloon 52 by repeated squeezing of the bulb 17 will disperse all of the solution 75 in any orientation of the applicator 10.

To interrupt the application of the solution, the individual squeezes the thumb pad 35 to activate the pressure relief valve 31 and return the pressure inside the balloon to atmospheric pressure thereby stopping the flow. For extended interruption, the individual may also replace the cover 13.

Each of the structures in this applicator 10 can be readily formed by injection molding and other similar low cost manufacturing processes. The squeeze bulb 17, one-way valves 27 and 30 and the pressure relief valve are all commercially available or readily adapted for use with the applicator 10. Moreover, these components never contact any solution, so they do not require cleaning after every use. Consequently the hollow member 11 and inflatable bladder member 40, that can be produced at very low cost, can be provided as disposable devices thereby eliminating any cleaning requirements. As another advantage, an individual can use the applicator 10 with only one hand. The individual can easily grasp the handle member 14 with fingers positioned to operate the squeeze bulb 17 and the thumb readily positioned to operate the pressure relief valve 31, both while retaining a firm grasp on the handle member 14.

Therefore in accordance with the objectives of this invention, the solution applicator 10 is easy to use. The handle member 14 requires no cleaning and can be reused. Thus the applicator 10 can be constructed to have disposable components to eliminate any cleaning requirements. The reliability of various components, such as the valves and squeeze bulb 17, are enhanced so the handle member 14 can be reused many times.

Many modifications could be made to the specifically disclosed embodiment of the applicator 10. A single row of comb teeth 12 is shown. Multiple rows could be substituted. Specific configurations and forms of the applicator 10 have been disclosed. Other configurations with other profiles and other interconnecting devices could all be substituted for those specifically shown by persons of ordinary skill in the art. Thus, while this invention has been disclosed in terms of certain embodiments, it will be apparent that the foregoing and many other modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An applicator for applying a solution to hair comprising:

A) a hollow member forming a manifold with a plurality of dispensing ports for dispensing the solution and a fill port for receiving solution, B) an inflatable bladder positioned in said manifold and having a seal for closing said fill port, and C) a handle for connection to said hollow member and said inflatable bladder proximate said fill port, said handle including a pump for expanding said bladder thereby to dispense the solution from said manifold through said dispensing ports onto hair.

2. An applicator as recited in claim 1 wherein said inflatable bladder includes:

i) a support body, ii) a conduit with first and second ends carried intermediate said ends by said support body, said first end being adapted for connection to said pump as an inlet to said conduit and said conduit having at least one aperture therethrough intermediate said support body and said second end, and iii) a balloon having an expansible body extending over said conduit from the second end to a position adjacent said support body and a neck attached to said conduit proximate said support body.

3. An applicator as recited in claim 2 wherein said seal at said fill port includes a first annular seal for placement between said support body and said hollow member, and a second annular seal intermediate said balloon neck and said hollow member.

4. An applicator as recited in claim 2 wherein said pump comprises:

i) a squeeze bulb having inlet and outlet ports, ii) a one way inlet valve connected to said inlet port, and iii) a one-way outlet valve connected to said output port whereby squeezing of said squeeze bulb inflates said balloon and dispenses solution from said dispenser ports.

5. An applicator as recited in claim 4 including another seal at said inlet end of said conduit.

6. An applicator as recited in claim 5 including a manually operated pressure relief valve intermediate said outlet valve and said inlet end of said conduit.

7. An applicator as recited in claim 2 wherein said pump comprises:

i) a squeeze bulb having inlet and outlet ports, ii) a one-way inlet valve connected to said inlet port, and iii) a one-way outlet valve connected to said output port whereby squeezing of said squeeze bulb inflates said balloon and dispenses hair dye from said dispenser ports.

8. An applicator as recited in claim 7 including a manually operated pressure relief valve intermediate said outlet valve and said inlet end of said conduit.

9. An applicator as recited in claim 7 wherein said handle includes a housing forming an internal cavity for storing solution and including a closed end and an open neck end, said open neck end receiving said inflatable bladder and said handle.

10. An applicator as recited in claim 9 wherein said handle and said hollow member having complementary releasable locking elements.

11. An applicator as recited in claim 2 wherein said hollow member includes a housing that defines an internal cavity and a plurality of comb teeth longitudinally extending therefrom, each of said comb teeth having a longitudinal passage therethrough extending from said cavity.

12. An applicator as recited in claim 11 including a cover for said comb teeth.

13. A hair dye applicator for applying hair dye to selected portions of a person's hair, said applicator comprising:

A) a comb member having a housing with an open neck end and a closed end defining an internal cavity therebetween and having a plurality of comb teeth extending from said housing, each of said comb teeth having a longitudinal passage therethrough for dispensing hair dye in said cavity through the comb teeth, B) an inflatable member in said cavity and extending through said open neck end of said housing, said inflatable member including a support body for being sealed against said comb member housing, a conduit extending through said support body to define an air passage and a balloon overlying said conduit on one side of said support body whereby said balloon can be immersed in the hair dye in said housing cavity, C) a handle containing an air pump having an outlet port that can be sealed to said conduit on the other side of said support body whereby operation of said air pump expands said balloon and displaces hair dye from said cavity through each longitudinal passage in said comb teeth.

14. A hair dye applicator as recited in claim 13 wherein said inflatable bladder includes:

i) a support body, ii) a conduit with first and second ends carried intermediate said ends by said support body, said first end being adapted for connection to said pump as an inlet to said conduit and said conduit having at least one aperture therethrough intermediate said support body and said outlet end, and iii) a balloon having an expansible body extending over said conduit from said second end to a position adjacent said support body and a neck attached to said conduit proximate said support body.

15. A hair dye applicator as recited in claim 14 wherein said seal at said fill port includes a first annular seal for placement between said support body and said hollow member, and a second annular seal intermediate said balloon neck and said hollow member.

16. A hair dye applicator as recited in claim 14 wherein said pump comprises:

i) a squeeze bulb having inlet and outlet ports, ii) a one-way inlet valve connected to said inlet port, and iii) a one-way outlet valve connected to said output port whereby repeated squeezing of said squeeze bulb inflates said balloon and dispenses hair dye from said dispenser ports.

17. A hair dye applicator as recited in claim 16 including another seal at said inlet end of said conduit.

18. A hair dye applicator comprising:

A) dispensing means for dispensing hair dye in a cavity through passages in a plurality of comb teeth and including fill port means for receiving hair dye, B) inflatable means extending through said fill port means into said dispensing means cavity for being expanded in said cavity thereby to dispense hair dye through said passages, C) sealing means between said dispensing means and said inflatable means for preventing hair dye from escaping through said fill port means, D) handle means attached to said dispensing means and said inflatable means for enabling an individual to grasp said hair dye applicator, said handle means including pump means for directing air into said inflatable means whereby operation of said pump means expands said inflatable means and ejects hair dye from said cavity through each said dispensing passage, and E) sealing means between said handle means and said dispensing means for preventing hair dye from entering said handle means.

* * * * *